United States Patent [19]

Conley

[11] Patent Number: 4,735,546

[45] Date of Patent: Apr. 5, 1988

[54] APPARATUS FOR MANIPULATING RADAR DRIVE ASSEMBLIES

[75] Inventor: Michael P. Conley, Fallston, Md.

[73] Assignee: Westinghouse Electric Corp., Pittsburgh, Pa.

[21] Appl. No.: 17,299

[22] Filed: Feb. 20, 1987

[51] Int. Cl.[4] ..... B66F 9/00

[52] U.S. Cl. ..... 414/607; 414/589; 414/590

[58] Field of Search ..... 414/589, 590, 785, 607

[56] References Cited

U.S. PATENT DOCUMENTS

| | | | |
|---|---|---|---|
| 2,189,010 | 2/1940 | Lewis | 414/680 |
| 2,410,373 | 10/1946 | Westervelt, Jr. | 414/607 |
| 3,270,900 | 9/1966 | Sherman | 414/607 X |
| 3,606,952 | 9/1971 | Mankey | 414/607 X |
| 4,049,146 | 9/1977 | Decker | 414/607 |

*Primary Examiner*—Robert J. Spar

*Assistant Examiner*—Jennifer Doyle

*Attorney, Agent, or Firm*—R. P. Lenart

[57] ABSTRACT

An apparatus for manipulating radar drive mechanisms is provided with a workpiece support assembly including a generally horizontal base and at least two sides extending vertically from the base to form a chamber for receiving a bottom portion of the drive mechanism. An adjustable height vertical member extends from the support assembly base and is capable of being secured to various components of the drive mechanism. An alignment saddle positioned below the support assembly is used for adjustment of angular orientation of the support assembly and associated drive mechanism, and is pivotally mounted on a support structure to permit rotation of the drive mechanism for disengagement from the radar tower pedestal. The support assembly, alignment saddle, and saddle support structure are mounted on a forklift which provides convenient vertical motion.

6 Claims, 3 Drawing Sheets

APPARATUS FOR MANIPULATING RADAR DRIVE ASSEMBLIES

BACKGROUND OF THE INVENTION

This invention relates to materials handling apparatus and more particularly to such apparatus which provides for the support, maneuverability, elevation, alignment and rotation of radar drive mechanisms.

One type of air surveillance radar tower includes a radar pedestal positioned approximately 9 feet above an elevated mezzanine floor. Two vertically oriented radar drive mechanisms extend downward approximately 40 inches from the radar pedestal. Each drive mechanism includes a gear reducer and a drive motor which are aligned along a common axis and have a combined total weight of about 380 pounds. To achieve maximum radar availability, specifications require that a failed drive mechanism must be replaced from beneath the pedestal while the radar is operational.

Each drive mechanism includes a pinion which engages a bull gear in the pedestal to rotate the radar antenna. The drive mechanisms are configured such that rotation of the drive mechanisms will disengage the pinion from the bull gear so that the drive mechanisms can be removed for repair or replacement. When a drive mechanism is being replaced, the antenna may be shut down for no more than 120 seconds to permit engagement of the pinion of the drive mechanism with the bull gear.

A materials handling apparatus, which is used in the removal and replacement of such radar drive mechanisms, must include means for supporting, maneuvering, elevating, aligning and rotating the drive mechanism. Because of the relatively large weight of each drive mechanism, the apparatus should also provide for independent removal of the drive mechanism motor and gear reducer.

SUMMARY OF THE INVENTION

A materials handling apparatus for raising, lowering and vertically supporting a radar drive mechanism, constructed in accordance with the present invention includes a radar drive mechanism support assembly having a generally horizontal base, at least two sides extending vertically from the base to form a chamber for receiving the bottom of the drive assembly motor or gear reducer, an adjustable height vertical member extending from the base and means for securing a component of the drive assembly to the vertical member. An alignment saddle is attached to the drive mechanism support assembly base. The alignment saddle includes means for adjusting the angular orientation of the support assembly. A saddle support structure is positioned below the alignment saddle and includes means for pivotally mounting the alignment saddle with respect to the saddle support structure. Means is included for vertically raising and lowering the saddle support, alignment saddle and drive mechanism support assembly.

By providing an adjustable height vertical member on the drive mechanism support assembly, the apparatus can be used to manipulate the drive mechanism motor and gear reducer separately or together as a complete assembly.

DESCRIPTION OF THE PREFERRED EMBODIMENT

Figure 1:
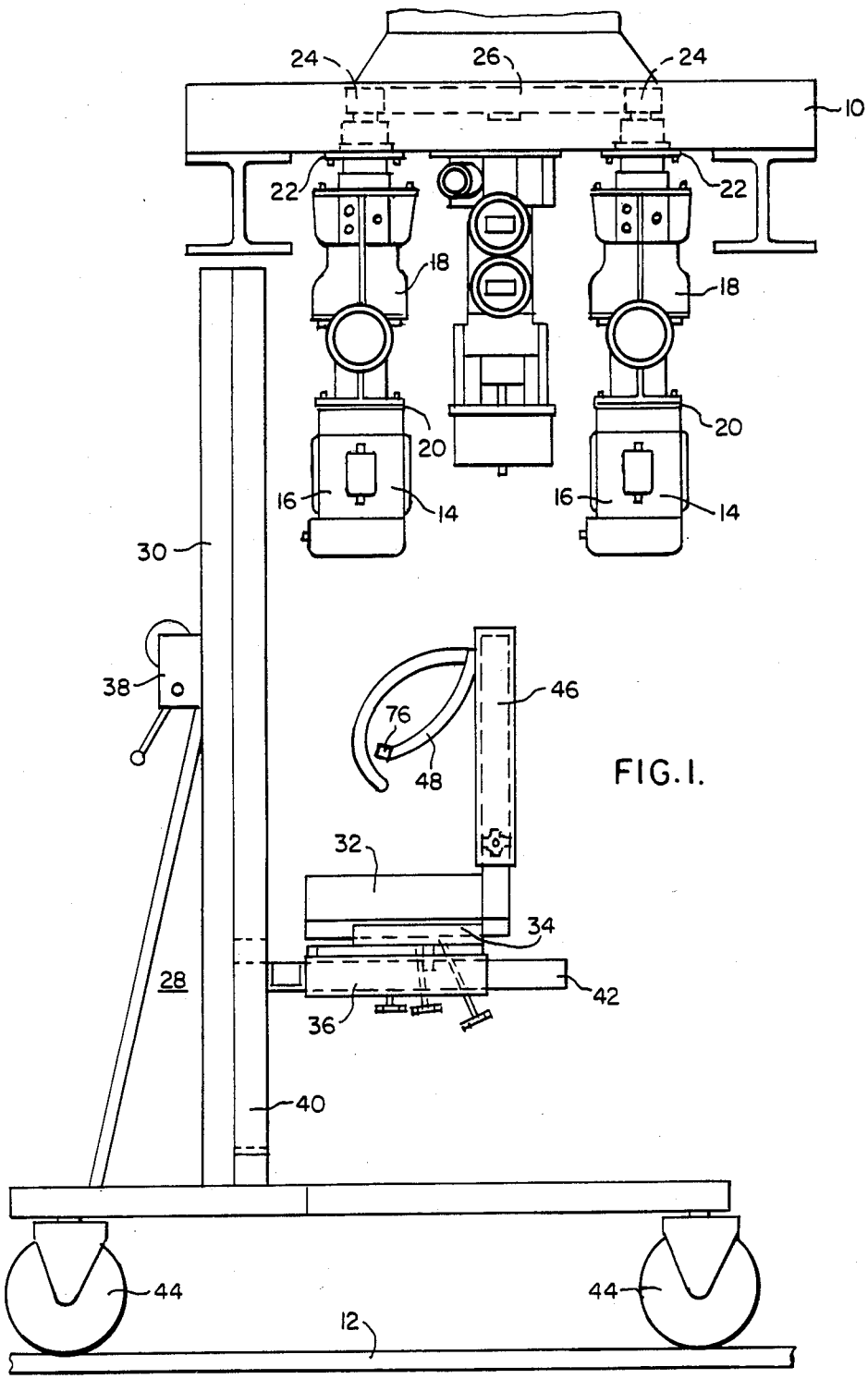
FIG. 1 is a side view of a materials handling apparatus constructed in accordance with one embodiment of the present invention.

Referring to the drawings, FIG. 1 is a side view of one embodiment of the apparatus of the present invention shown with a portion of its operating environment. The radar towers for which the preferred embodiment of this invention was designed include a pedestal 10 which is positioned by support structures, not shown, approximately 9 feet above a mezzanine floor 12. The mezzanine floor is positioned above the ground and is a grated structure that does not provide a smooth horizontal working surface. The tower includes two radar drive mechanisms 14 which extend vertically downward from the pedestal for a distance of about 40 inches. Each drive mechanism includes a motor 16 and a gear reducer 18 with are aligned along a common axis. The gear reducer and motor are bolted together at a joint 20. A plurality of bolts through a plate 22 serves to attach each drive mechanism to the radar pedestal 10. Pinions 24 extend vertically from the drive mechanisms and engage a bull gear 26 at the base of the radar antenna. It should be noted that although the area around the drive mechanisms is shown in FIG. 1 to be relatively free of obstructions, in actuality, numerous sensors, wires and other devices provide a relatively congested environment around the drive mechanisms. However, these other devices have not been illustrated in FIG. 1 since they would unnecessarily complicate the drawing.

The apparatus of the present invention is generally designated as item number 28 in FIG. 1 and includes a portable manual forklift 30, a workpiece support assembly 32, an alignment saddle 34 positioned beneath the workpiece support assembly, and a saddle support structure 36 to which the alignment saddle is pivotally attached.

The forklift 30 includes a winch 38 for raising and lowering a carriage assembly 40. The carriage assembly includes a pair of generally horizontal tines 42 which form the fork that supports the saddle support 36. One embodiment of this invention has been constructed by using a forklift available as Part No. 110095-100-S-002 from Genie Industries, Redmond, Wash. That forklift was modified by providing it with four 12 inch diameter swivel casters 44 and by inverting the carriage so that vertical parts of the carriage would not interfere with the operation of the present invention. The relatively large diameter casters provide good maneuverability characteristics and tend to reduce the effects of the mezzanine grating on the stability of the apparatus.

The workpiece support assembly 32 includes an adjustable height vertical member 46 and means for securing portions of the drive mechanism to this vertical member in the form of a belt 48. The alignment saddle 34 beneath the workpiece support assembly permits accurate orientation of the support assembly and a radar drive mechanism which may be attached to it. By mounting the alignment saddle in a pivotal relationship with the saddle support structure, both the workpiece support assembly and an associated drive mechanism can be rotated to disconnect the pinion from the radar tower bull gear.

Figure 2:
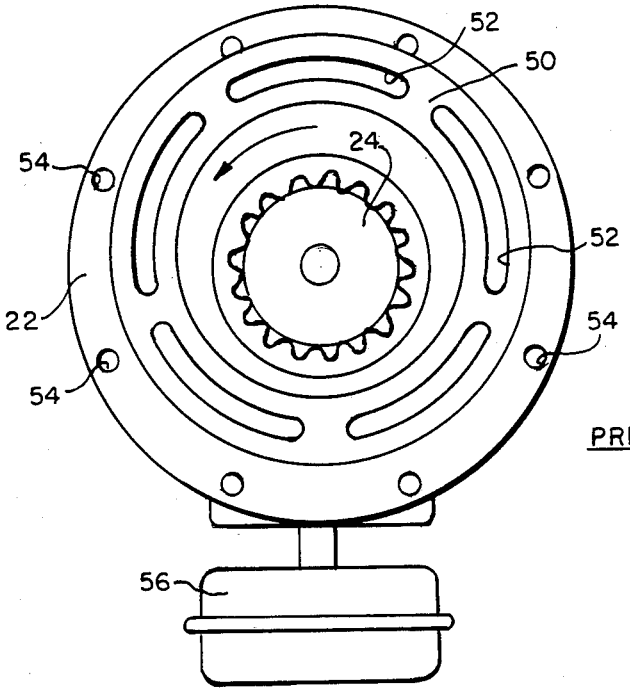
PRIOR ART FIG.2.
FIG. 2 is a top view of one of the radar drive mechanisms illustrated in FIG. 1.

FIG. 2 is provided to illustrate how rotation of the drive mechanism is used to disengage the pinion. Each drive mechanism includes a plate 50 which has a plurality of slots 52 and is mounted within the radar pedestal. This plate is offset with respect to the axis of the pinion and is positioned such that studs in the radar pedestal extend into its slots. When disengagement is to be accomplished, the forklift carriage 40 of FIG. 1 is raised such that the bottom of the drive mechanism is received within the workpiece support assembly 32 and the drive mechanism is attached to the workpiece support assembly vertical member by way of belt 48. With the drive mechanism vertically supported, bolts 54 in FIG. 2 are removed from plate 22 and the drive mechanism is manually rotated such that the sliding of the studs in slots 52 cause the pinion 24 to be moved radially away from the bull gear. Then the drive mechanism can be lowered by lowering the carriage of the forklift. Care must be taken to ensure that structures such as expansion chamber 56 which extend from the sides of the drive mechanism are not damaged during this process.

Figure 3:
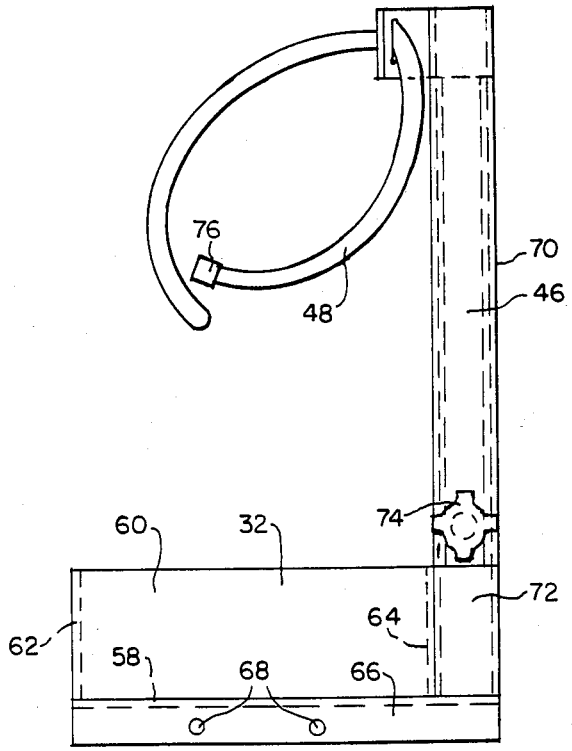
FIG. 3 is a side view of the drive mechanism support assembly of the apparatus of FIG. 1.

FIG. 3 is a side view of the workpiece support assembly 32 of the apparatus 28 in FIG. 1. This assembly is seen to include a generally horizontally base 58 and a plurality of sides 60, 62 and 64 which extend vertically from the base. The base also includes flanges 66 on opposite edges of the base which extend downward and include openings 68 for attachment to the alignment saddle. The vertical member 46 is shown to include two telescoping portions 70 and 72 as well as a stop 74 which can be used to adjust the vertical height of the member 46. Belt 48 includes a fastening device 76 which is used to secure the belt around the drive mechanism. By adjusting the height of the vertical member 46 to its lowest level the belt will be in position to secure the motor to the vertical member so that the motor can be disconnected from the gear reducer at joint 20 in FIG. 1 and removed separately. Similarly, by adjusting the height of the vertical member to a second higher level, the position of the belt 48 will be such that it can easily be extended around the gear reducer in the event that both the motor and gear reducer are to be removed simultaneously.

Figure 4:
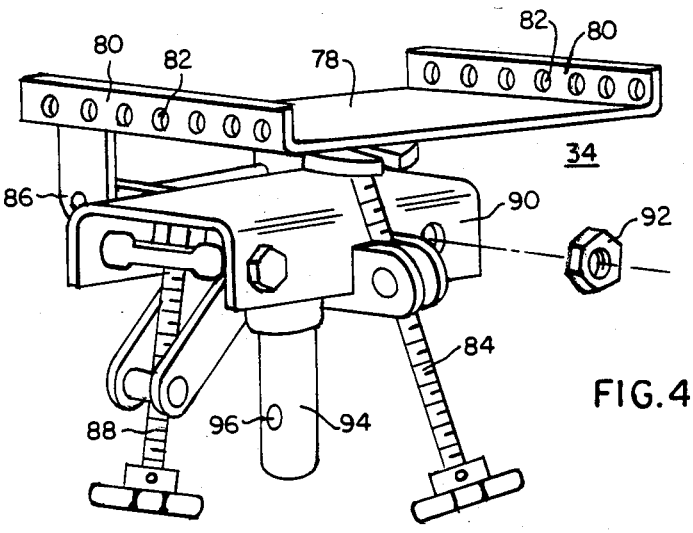
FIG. 4 is a perspective view of the alignment saddle of the apparatus of FIG. 1.

FIG. 4 is a perspective view of the alignment saddle used in the apparatus 28 of FIG. 1. This saddle includes a generally horizontal member 78 having flanges 80 on opposite edges. Holes 82 are provided in the flanges so that bolts can be used to attach the workpiece support assembly 32 to the alignment saddle. An adjusting screw 84 is provided to pivot the generally horizontal members 78 about pin 86 and adjustment screw 88 is provided to pivot a base structure 90 about a bolt secured by nut 92. These adjusting screws thereby provide for accurate angular positioning of the generally horizontal member 78 and accurate angular positioning of the workpiece support assembly 32. A pivot pin 94 extends vertically downward from the alignment saddle and includes an opening 96 for receiving a locking pin. The alignment saddle of FIG. 4 has been constructed by using a transmission jack saddle Part No. TK 703 available from Applied Power Incorporated, Milwaukee, Wis. That commercially available alignment saddle was modified by removing all clips and chains and a welded cross bar, thereby making it suitable for use in the apparatus 28 of FIG. 1.

Figure 5A:
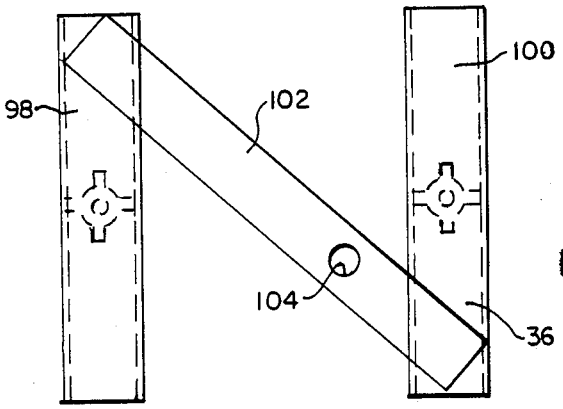
FIGS. 5A and 5B are top and end views of the alignment saddle support structure of the apparatus of FIG. 1.
Figure 5B:
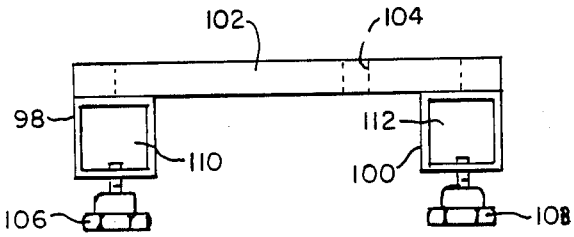

FIGS. 5A and 5B are top and end views of the saddle support structure 36 of FIG. 1. This saddle support structure includes a pair of tubular members 98 and 100 for receiving the forklift tines and a cross member 102 having an opening 104 for receiving the pivot pin 94 of the alignment saddle. Securing knobs 106 and 108 are used to secure the saddle support to the forklift when the forklift tines are inserted in openings 110 and 112.

The radar tower for which the preferred embodiment of this invention was designed includes a hoist, attached to the pedestal, which is limited to 300 pounds. Since the radar drive mechanisms weigh approximately 380pounds, it is clear that the motor and gear reducer must be separated prior to being raised or lowered by the hoist. The workpiece support assembly of this invention is particularly adapted to remove the motor and gear reducer separately. Such a removal procedure not only makes the removed components easier to handle, but also keeps all removed components within the hoist weight limit. Although the present invention has been described in terms of what is at present believed to be its preferred embodiment, it will be apparent to those skilled in the art that various changes may be made without departing from the scope of the invention. It is therefore intended that the appended claims cover such changes.

What is claimed is:

1. A materials handling apparatus for raising, lowering and vertically supporting a workpiece, having two separable components aligned along a generally vertical axis, and for rotating at least a portion of said workpiece about said axis, said apparatus comprising in combination:

a workpiece support assembly including a generally horizontal base, at least two sides extending vertically from said base to form a chamber for receiving a bottom portion of a workpiece, an adjustable height vertical member extending from said base, and means for securing said workpiece to said vertical member;

an alignment saddle attached to said workpiece support assembly base, said alignment saddle including means for adjusting the angular orientation of said workpiece support assembly;

a saddle support structure;

means for pivotally mounting said alignment saddle with respect to said saddle support structure;

means for vertically raising and lowering said saddle support, said alignment saddle and said workpiece support asssembly, wherein:

said means for raising and lowering comprises a forklift having a pair of generally horizontal tines; and wherein said saddle support structure includes means for receiving said tines and a support bar extending between said tine receiving means.

2. An apparatus as recited in claim 1, wherein said vertical member is adjustable from a first height, wherein said means for securing attaches to a bottom section of said workpiece, to a second height wherein said means securing attaches to a top section of said workpiece.

3. An apparatus as recited in claim 1, wherein said means for pivotally mounting said alignment saddle comprises:

an opening in said support bar; and a pivot pin extending from said alignment saddle into said opening.

4. An apparatus as recited in claim 1, wherein:

said support bar is generally horizontal and defines a generally vertical opening; and said means for pivotally mounting said alignment saddle comprises a pivot pin extending from said alignment saddle into said opening.

5. An apparatus as recited in claim 1, wherein said adjustable height vertical member includes:

two telescoping elements and means for fixing the position of one of said elements with respect to the other.

6. An apparatus as recited in claim 1, wherein said means for securing includes:

an adjustable belt, attached to said vertical member, for positioning around said workpiece.

* * * * *